US008237524B2

(12) United States Patent
Niimi et al.

(10) Patent No.: US 8,237,524 B2
(45) Date of Patent: Aug. 7, 2012

(54) ELECTROMAGNETIC SWITCHING DEVICE

(75) Inventors: Masami Niimi, Handa (JP); Kiyokazu Haruno, Anjo (JP); Tarou Okada, Owariasahi (JP); Hiroaki Higuchi, Kariya (JP)

(73) Assignee: Denso Corporation, Kariya (JP)

( * ) Notice: Subject to any disclaimer, the term of this patent is extended or adjusted under 35 U.S.C. 154(b) by 3 days.

(21) Appl. No.: 12/892,170

(22) Filed: Sep. 28, 2010

(65) Prior Publication Data

US 2011/0084786 A1 Apr. 14, 2011

(30) Foreign Application Priority Data

Sep. 30, 2009 (JP) ..... 2009-226295

(51) Int. Cl.
*H01H 9/00* (2006.01)

(52) U.S. Cl. ..... 335/177; 335/126; 335/131; 335/132

(58) Field of Classification Search ..... 335/126, 335/131, 132
See application file for complete search history.

(56) References Cited

U.S. PATENT DOCUMENTS

| | | | | |
|---|---|---|---|---|
| 5,677,656 | A * | 10/1997 | Mauch et al. | 335/126 |
| 5,892,422 | A * | 4/1999 | Montaigu et al. | 335/126 |
| 5,901,604 | A * | 5/1999 | Sato et al. | 74/7 A |
| 5,909,067 | A * | 6/1999 | Liadakis | 310/14 |
| 7,982,565 | B2 * | 7/2011 | Bradfield et al. | 335/184 |

FOREIGN PATENT DOCUMENTS

JP B2-3162242 4/2001

* cited by examiner

*Primary Examiner* — Lincoln Donovan
*Assistant Examiner* — Lisa Homza
(74) *Attorney, Agent, or Firm* — Oliff & Berridge, PLC

(57) ABSTRACT

A first coil constitutes a first coil unit by placing an iron core plate between the first coil and an auxiliary yokes and engaging stopping parts provided in two holding members to an end surface in an axial direction of the auxiliary yoke. A second coil constitutes a second coil unit by forming magnetic path members by insertion to a resin member provided in a second bobbin unitarily, and fixing two terminals to the resin member. The first and the second coil units are united by connecting one terminal lead line of the first coil taken out from holding members to the first terminal, and connecting another terminal lead line to a surface of the magnetic path member.

7 Claims, 5 Drawing Sheets

SU
10
11
41
40
43
29
13
13b
13a
15
32
25
37
26
38
34
28

ELECTROMAGNETIC SWITCHING DEVICE

CROSS-REFERENCE TO RELATED APPLICATION

This application is based on and claims the benefit of priority from earlier Japanese Patent Application No. 2009-226295 filed Sep. 30, 2009, the description of which is incorporated herein by reference.

BACKGROUND OF THE INVENTION

1. Technical Field of the Invention

This invention relates to electromagnetic switching devices for starters, particularly for an electromagnetic switching device that has a solenoid for pinion extrusion and a solenoid for motor energization accommodated inside one cylindrical case unitarily.

2. Description of the Related Art

There is disclosed an electromagnetic switching device for starters in Japanese Patent Publication No. 3162242 as conventional technology.

The electromagnetic switching device moves a starter's pinion in an axial direction by driving a first movable iron core.

The electromagnetic switching device also has a first solenoid that closes a switch for energizing a motor, and a second solenoid that closes only the switch for energizing the motor by driving a second movable iron core without moving the pinion in the axial direction.

The first solenoid and the second solenoid are accommodated axially in line in one case that has a cylindrical shape.

The above-mentioned electromagnetic switching device is constituted accommodating the first and second solenoids in one case unitarily.

Therefore, miniaturization can be realized as compared with the case where accommodating two solenoids in a separate case independently, and the two solenoids being arranged in the axial direction.

However, it is natural that when assembling the electromagnetic switching device mentioned above, it is necessary to assemble two solenoids into the case in order, while the solenoids are at least positioned in the direction of a circumference.

In this case, since there is many man-hours required for assembling, and the time required for assembling increases, manufacturing cost will increase.

Further, since the first solenoid assembled first will be accommodated in a deep position within the case, there is a problem that the assembling is difficult.

That is, since the electromagnetic switching device disclosed in the JP Publication No. 3162242 is difficult to assembling, it becomes an important subject in mass production.

SUMMARY OF THE INVENTION

The present invention has been made in light of the circumstances provided above, and has as its object to provide an electromagnetic switching device that can improve the ease of assemble, and can cut costs by shortening the assembling time.

In an electromagnetic switching device according to a first aspect, the electromagnetic switching device includes a solenoid for pinion extrusion that extrudes a starter's pinion in a axial direction by using an attraction force of an electromagnet generated by an energization to a first coil that is wound around a first bobbin and a solenoid for motor energization that closes a main switch that intermits a current flowing to a starter motor from a battery by using an attraction force of an electromagnet generated by an energization to a second coil that is wound around a second bobbin.

The solenoid for pinion extrusion and the solenoid for motor energization are arranged axially in line in an axial direction to constitute the electromagnetic switching device for starters unitarily.

The electromagnetic switching device further includes a case having a cylindrical shape with a bottom that has a ring-shaped bottom at one end side in an axial direction and an opening at other end side.

The first coil and the second coil are accommodated in a bottom side within the case and in an top side within the case, respectively, and an iron core plate that forms a part of magnetic circuit for the first coil and the second coil is arranged between the both coils.

The first bobbin has a pair of flange plates that hold both sides in an axial direction of the first coil, and the first bobbin has a plurality of holding members that extend in the axial direction to the second coil side from one of the flange plates in the iron core plate side, and stopping parts provided in the holding member.

Extracting portions that can extract the holding members to the second coil side is formed in the iron core plate.

The holding members are extracted from the extracting portions to the second coil side in the state where the iron core plate is arranged between the first coil and the second coil, and the solenoid for pinion extrusion and the solenoid for motor energization are accommodated in the case in the state where the first coil and the second coil are united by engaging the stopping parts to parts of the solenoid for motor energization.

According to the above-mentioned composition, when two solenoids are attached to the case, the first coil and the second coil are united in the state where the iron core plate is arranged therebetween.

Consequently, it is not necessary to accommodate the first coil and the second coil in the case separately, and two coils can be accommodated in the case in one operation.

As for the case used for the electromagnetic switching device of the present invention, since two solenoids are arranged axially in line in the axial direction, the length is long in the axial direction, that is, the bottom is deep.

Since it is not necessary to accommodate while supporting the first coil independently into the case deeply, the assembling nature can be improved.

That is, since the first and the second coils can be accommodated in the case while holding the parts of the solenoid for motor energization arranged at the entrance side (other end side) of the case, the two solenoids can be attached simultaneously in a short time.

In the electromagnetic switching device according to a second aspect, a lead line passage is formed in the holding member, and a terminal lead line of the first coil is pulled out in an axial direction through the lead line passage.

The lead line passage may be a through hole that penetrates an inside of the holding member in the longitudinal direction, or a slot-shaped opening formed along a longitudinal direction of the holding member.

In the electromagnetic switching device according to a third aspect, the solenoid for motor energization includes a magnetic path member that intersects perpendicularly with an axial direction of the second coil, and is arranged at an anti-iron core plate side of the second coil to form a part of magnetic circuit, and a cylindrical auxiliary yoke inserted touching an inner circumference of the case, and is arranged between the iron core plates and the magnetic path members through an outside in a radial direction of the second coil to connect the iron core plates and the magnetic path members magnetically.

The pillar-shaped holding members are arranged passing through an inner circumference side of the auxiliary yoke in the axial direction, and the stopping parts provided in a tip part of the holding members are engaging with an end surface in an axial direction of the anti-iron core plate of the auxiliary yoke.

In the electromagnetic switching device according to a fourth aspect, the stopping parts provided in the tip part of the holding members have stopping surfaces that project towards an approximately right-angled direction to a longitudinal direction of the holding members, and the stopping surfaces engage with the end surface in the axial direction of the anti-iron core plate of the auxiliary yoke.

In the electromagnetic switching device according to a fifth aspect, the magnetic path member is formed by insertion to a resin member provided in the second bobbin unitarily, and constituted with the second coil unitarily.

In the electromagnetic switching device according to a sixth aspect, a first terminal and a second terminal that are connected to the battery are fixed to the resin member provided in the second bobbin unitarily.

In the two terminal lead lines of the first coil pulled out in the axial direction through the lead line passage formed in the holding member, one of the terminal lead lines is connected to the first terminal, while the other one of the terminal lead lines of the first coil is connected to the magnetic path member and grounded, and in the two terminal lead lines of the second coil, one of the terminal lead lines is connected to the second terminal, while the other one of the terminal lead lines of the second coil is connected to the magnetic path member and grounded.

DETAILED DESCRIPTION OF THE PREFERRED EMBODIMENTS

With reference to the accompanying drawings, hereinafter will be described an embodiment of the present invention.

Figure 5:
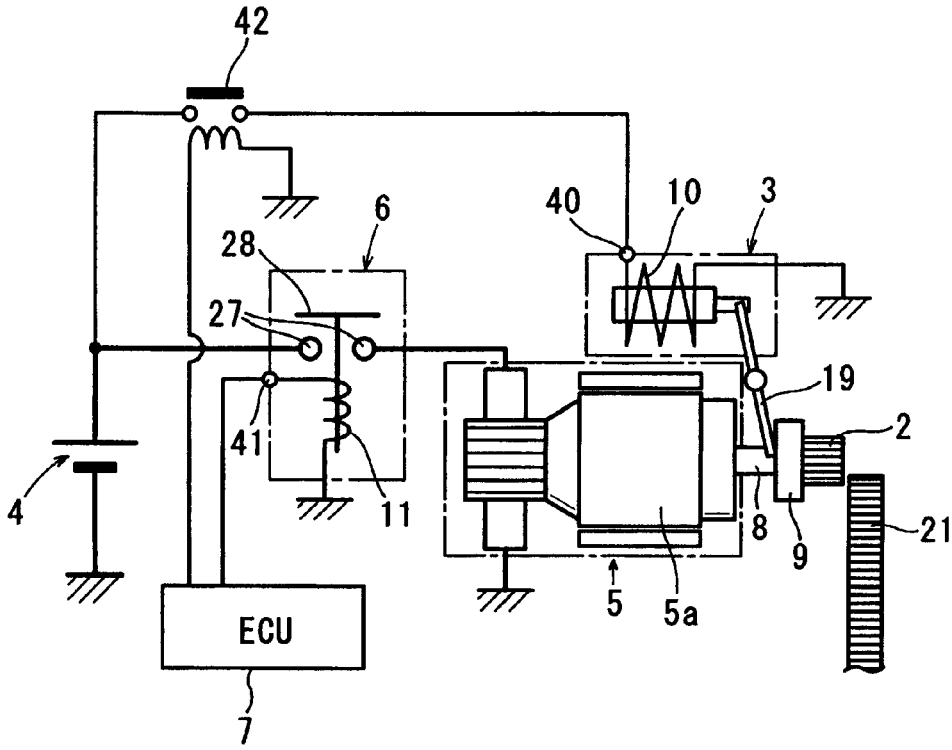
FIG. 5 shows an electric circuit diagram of a starter.

As shown in FIG. 5, an electromagnetic switching device 1 of the present embodiment includes a solenoid 3 for pinion extrusion (hereafter called "pinion solenoid") that extrudes a starter's pinion 2 in a axial direction (right side in the figure), and a solenoid 6 for motor energization (hereafter called "motor solenoid") that closes a main switch (mentioned later) that intermits the current flowing to a motor 5 from a battery 4.

The starter having this electromagnetic switching device 1 is applied to a vehicle equipped with an idle stop system that controls a stop and a re-start of an engine automatically, and is constituted so that operations of the pinion solenoid 3 and the motor solenoid 6 can be independently controlled by an idle stop ECU 7, which is an electrical control unit.

A main body of the starter except the electromagnetic switching device 1 has a well-known composition wherein the torque generated on the motor 5 is amplified by a reduction gear (amplification by the reduction gear may not be necessary) and transmitted to an output shaft 8, and transmitted to the pinion 2 via an one-way clutch 9 arranged on a perimeter of the output shaft 8.

Hereafter, the composition of the electromagnetic switching device 1 is explained in detail.

Figure 1:
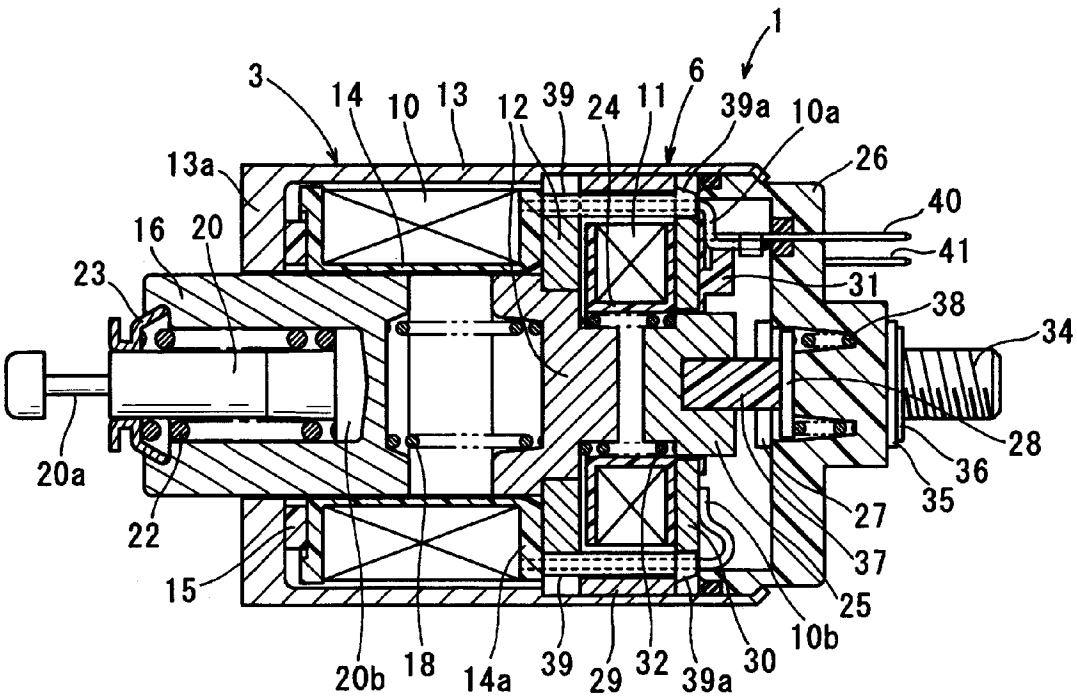
FIG. 1 shows a sectional view (A-A sectional view of FIG. 4B) of an electromagnetic switching device.

Each of the pinion solenoid 3 and the motor solenoid 6 has a first coil 10 and a second coil 11 that form an electromagnet by energization, respectively, as shown in FIG. 1.

A fixed iron core 12 used commonly with the first coil 10 and the second coil 11 is arranged between the both coils 10 and 11.

A first case that forms a yoke of the pinion solenoid 3 and a second case that forms a yoke of the motor solenoid 6 are formed axially in line in an axial direction, and the cases are formed unitarily as a whole case 13.

That is, the pinion solenoid 3 and the motor solenoid 6 are arranged axially in line in the axial direction (horizontal direction in the figure), and are constituted unitarily as the electromagnetic switching device 1 for starters.

Figures 3A, 3B, 3C:
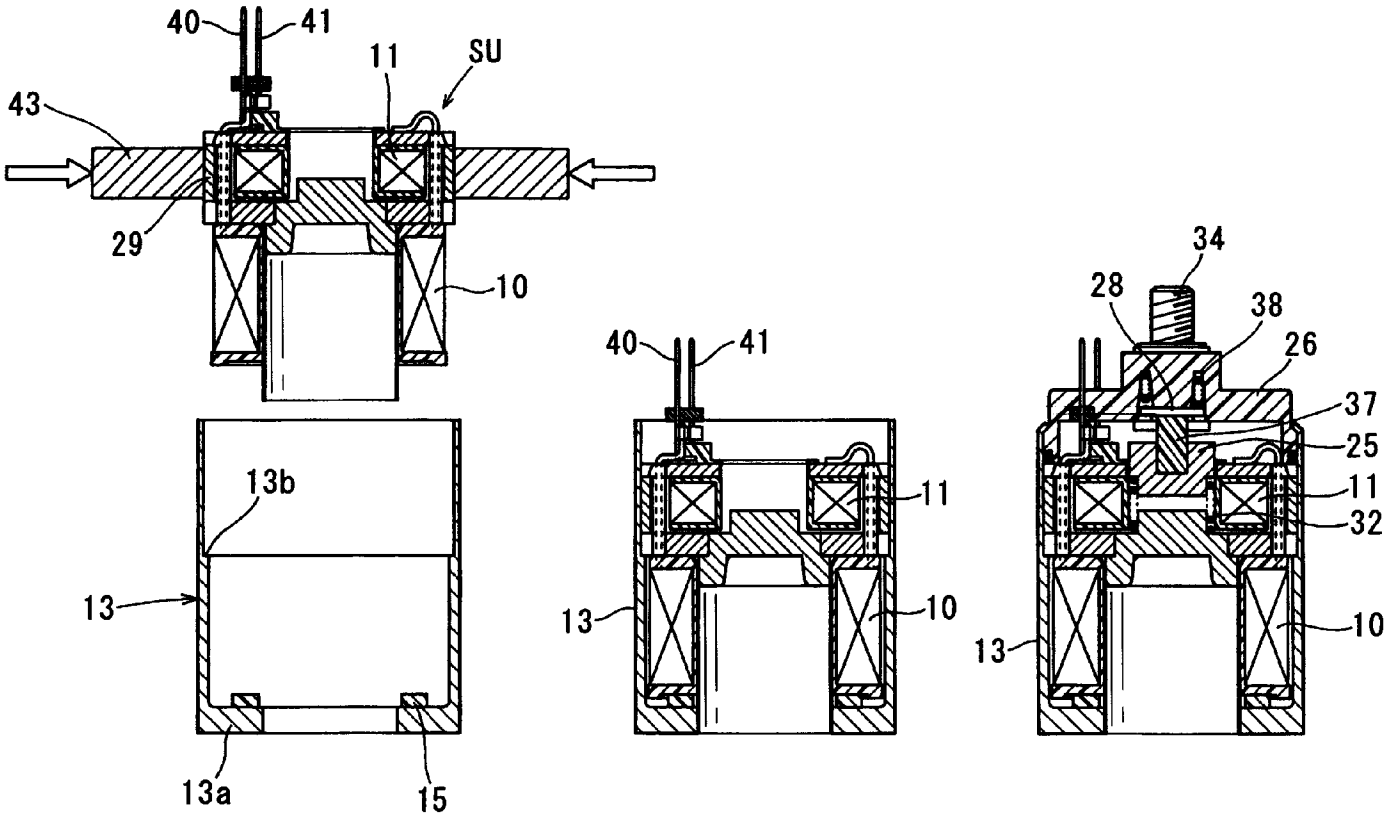
FIGS. 3A-3C show the assembling procedure of the electromagnetic switching device.

As shown in FIG. 3A, the whole case 13 (the first case and the second case) has a cylindrical shape with a bottom that has a ring-shaped bottom 13*a* at an end portion of an end side in the axial direction (bottom side in the figure), and other end side has an opening.

The whole case 13 is fixed to a starter's housing (not shown) via two stud bolts (not shown) provided in the bottom 13*a*.

The whole case 13 has an outer diameter with the same size from one end to the other end, and the other end side (opening side of the whole case 13) that forms the second case has a larger inner diameter and a thinner wall thickness than those of the one end side that forms the first case.

That is, a level difference 13*b* is provided on an inner circumference of the whole case 13 between the one end side in the axial direction that forms the first case and the other end side in the axial direction that forms the second case.

Figure 4B:
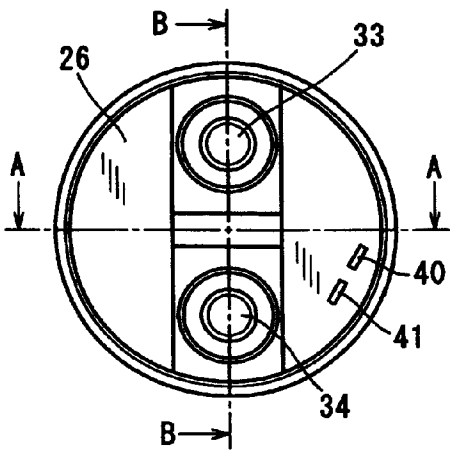
FIG. 4B shows a plane view of the electromagnetic switching device in an axial direction viewed from a resin cover side.
Figure 4A:
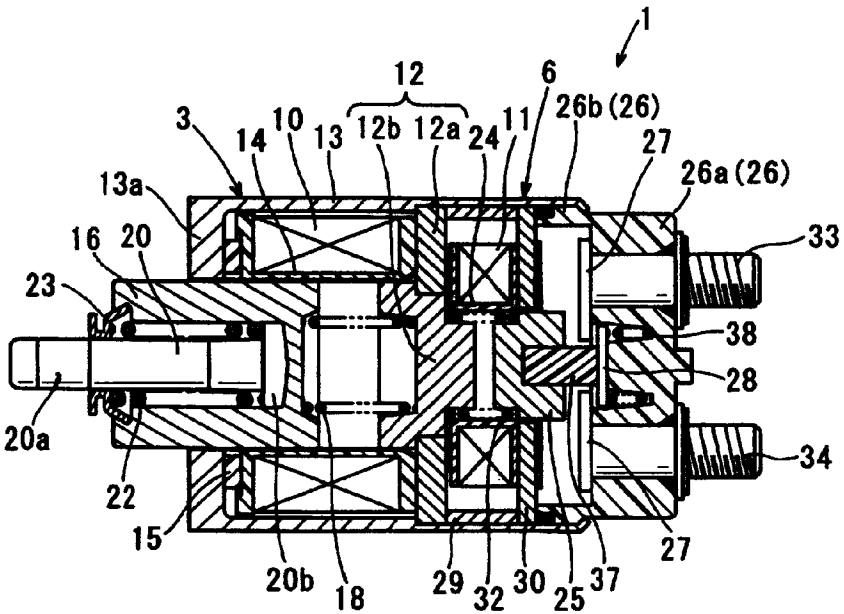
FIG. 4A shows a sectional view (B-B sectional view of FIG. 4B) of the electromagnetic switching device.

The fixed iron core 12 is constituted by divided into a ring-shaped iron core plate 12*a* and a core part 12*b* fixed to the inner circumference of the iron core plate 12*a* by fitting, as shown in FIG. 4A.

A perimeter end surface by the side of the first coil 10 of the iron core plate 12*a* contacts the level difference 13D provided in the inner circumference of the whole case 13, thus the iron core plate 12*a* is positioned relative to the direction of the bottom of the whole case 13.

As shown in FIG. 4A, the pinion solenoid 3 is accommodated in the inner space of the one end side of the whole case 13 (left-hand side of the iron core plate 12*a* in the figure) with its first coil 10 is wound around a resin-made bobbin (hereafter called "first bobbin 14").

A movement of the pinion solenoid 3 in the axial direction is suppressed between the bottom 13*a* of the whole case 13 and the iron core plate 12*a* by an elasticity of elastic bodies 15 (for example, rubber, a plate spring, etc.) that are arranged at the bottom side of the whole case 13.

An inner circumference of the first coil 10 is equipped with the plunger 16 that moves in an axial direction facing one adsorption side (left end side of FIG. 4A) of the core part 12*b*.

A cylindrical sleeve 17 (refer to FIG. 2A) that guides a movement of the plunger 16 is inserted in the inner circumference of the first bobbin 14.

When the fixed iron core 12 is magnetized by the energization to the first coil 10, the plunger 16 is adsorbed to one adsorption side of the core part 12*b* resisting an elasticity of a return spring 18 arranged between the plunger 16 and the core part 12*b*.

When the energization to the first coil 10 stops, the plunger 16 is pushed back in the direction of an anti-core part (left of FIG. 1) by the elasticity of the return spring 18.

The plunger 16 is formed approximately in the cylindrical shape with a cylindrical hole in a central part in a radial direction. The cylindrical hole opens to one end side of the plunger 16 (left-hand side of FIG. 1) while the other end side has a bottom.

A joint 20 for transmitting a motion of the plunger 16 to a gearshift 19 (referring to FIG. 5) and a drive spring 22 that stores an elasticity for engaging the pinion 2 to an engine ring gear 21 (referring to FIG. 5) are inserted in the cylindrical hole of the plunger 16.

A joint 20 is formed in a rod-shape, and an engagement slot 20*a* where one end portion of a gearshift 19 engages is formed in an end portion of one end side that projects from the cylindrical hole of the plunger 16, while a flange part 20*b* is provided in an end portion of other end side.

The flange part 20*b* has an outer diameter that can slide on the inner circumference of the cylindrical hole of the plunger 16, and is pressed to the bottom of the cylindrical hole in response to the load of the drive spring 22.

The drive spring 22 is placed between a spring receptacle part 23 that is crimp-fixed to the opening end of the plunger 16, and the flange part 20*b* of the joint 20.

When the plunger 16 is attracted by the core part 12*b* and moves, the plunger 16 is compressed and conserves the elasticity while the plunger 16 is adsorbed to one adsorption side of the core part 12*b*, after an end surface in an axial direction of the pinion 2 pushed out in an anti-motor direction (right of FIG. 5) via the gearshift 19 contacts an end surface in an axial direction of the ring gear 21.

As shown in FIG. 4A, the motor solenoid 6 is accommodated in the inner space of the other end side of the whole case 13 (right-hand side of the iron core plate 12*a* in the figure) with its second coil 11 is wound around a resin-made bobbin (hereafter called "second bobbin 24").

The motor solenoid 6 also has a movable iron core 25 that moves in the inner space of the second coil 11 in an axial direction facing another adsorption side of the core part 12*b*, and a resin cover 26 that is attached to close the opening that opens in other end side of the whole case 13.

A pair of fixed contacts 27 and a movable contact 28 that form a main switch is arranged inside of the resin cover 26.

A cylindrical auxiliary yoke 29 that forms a part of magnetic circuit and a plate-like magnetic path member 30 are arranged at an outside in a radial direction of the second coil 11, and an anti-iron core plate side in the axial direction of the second coil 11, respectively.

Outer diameters of both the auxiliary yoke 29 and the plate-like magnetic path member 30 are the same size as the outer diameter of the iron core plate 12*a*.

The auxiliary yoke 29 is inserted touching an inner circumference of the other end of the whole case 13 that forms the second case. An end surface of one end side of the auxiliary yoke 29 in the axial direction contacts the surface of the perimeter part of the iron core plate 12*a*, and is positioned in the axial direction relative to the iron core plate 12*a*.

The plate-like magnetic path member 30 is arranged perpendicular relative to the axial direction of the second coil 11, and is formed in a ring-shape having a round hole in its central part in a radial direction so that the movable iron core 25 can move in the axial direction.

The plate-like magnetic path member 30 is positioned in the axial direction relative to the auxiliary yoke 29 by having a perimeter part surface in the coil side in a thickness direction (left-hand side of FIG. 1) contacts an end surface of the auxiliary yoke 29 in the axial direction.

Figure 2A:
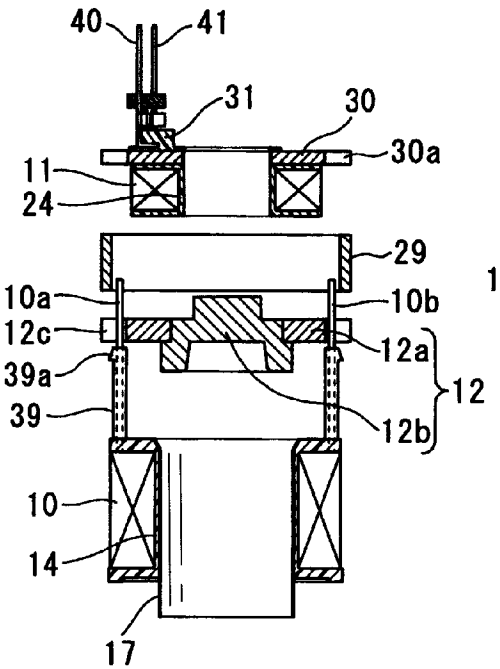
FIGS. 2A-2C show an assembling procedure of the electromagnetic switching device.

As shown in FIG. 2A, the plate-like magnetic path member 30 is formed by insertion to a resin member 31 provided in the second bobbin 24 unitarily, and constituted with the second coil 11 unitarily.

When the fixed iron core 12 is magnetized by the energization to the second coil 11, the movable iron core 25 is adsorbed to the other adsorption side of the core part 12*b* resisting an elasticity of a return spring 32 arranged between the fixed iron core 12 and the core part 12*b*.

When the energization to the second coil 11 stops, the movable iron core 25 is pushed back in the direction of an anti-core part (right of FIG. 1) by the elasticity of the return spring 32.

The resin cover 26 has, as shown in FIG. 4A, a bottom portion 26*a* in which two terminal bolts 33 and 34 are mounted, and a cylindrical leg part 26*b* extended in the axial direction from the perimeter of the bottom portion 26*a*.

A tip side of the leg part 26*b* is inserted into the inner circumference of the opening that opens in the other end of the whole case 13, and an end surface in an axial direction of the leg part 26*b* is positioned in the axial direction to the plate-like magnetic path member 30 in contact with the surface of the anti-coil side of the plate-like magnetic path member 30.

Further, the leg part 26*b* is fixed to the whole case 13 by crimping the end part of the whole case 13 to a level difference part formed in the perimeter side of the leg part 26*b*.

It should be appreciated that FIG. 4B is a plane view of the resin cover 26 in which the terminal bolts 33 and 34 are mounted viewed from the axial direction.

The terminal bolts 33 and 34 are a B terminal bolt 33 connected to a high potential side (battery side) of a motor circuit, and an M terminal bolt 34 connected to a low potential side (motor side) of the motor circuit.

The terminal bolts 33 and 34 are assembled to the resin cover 26 through penetration holes that penetrate the bottom portion 26*a* of the resin cover 26 in the axial direction, and each of the terminal bolts 33 and 34 is fixed to the resin cover 26 by two sheets of washers 35 and 36 (refer to FIG. 1).

A pair of the fixed contacts 27 is connected with the two terminal bolts 33 and 34 electrically and mechanically, as shown in FIG. 4A.

Although the fixed contact 27 and the terminal bolts 33 and 34 may be formed separately and join together, it is also possible to form the fixed contact 27 and the terminal bolts 33 and 34 unitarily using heads of the terminal bolts 33 and 34, for example.

The movable contact 28 is supported by an end surface of a rod 37 made of resin fixed to the movable iron core 25. The movable contact 28 is arranged at the anti-movable iron core side (right-hand side of FIG. 1) relative to the fixed contact 27, and is pushed on the end surface of the rod 37 in response to the load of a contact-pressure spring 38.

An initial load of the contact-pressure spring 38 is set smaller than an initial load of the return spring 32.

Therefore, when the second coil 11 is not energized, the movable contact 28 is placed on the internal end surface of the resin cover 26 in the state where the movable contact 28 pushes the contact-pressure spring 38 (state shown in FIG. 1).

The main switch becomes a closed state (ON) when the movable contact 28 contacts with a pair of the fixed contacts 27 so that between both the fixed contacts 27 is electrically connected. The main switch becomes an opened state (OFF), however, when the movable contact 28 separates from a pair of the fixed contacts 27 so that the electrical connection between both the fixed contacts 27 is intercepted.

Next, terminal processing of the first coil 10 and the second coil 11, and the composition of pillar-shaped holding members 39 of the present invention are explained.

As shown in FIG. 1 and FIG. 2A, the first coil 10 has two terminal lead lines 10*a* and 10*b* that are a start winding side and an end winding side wound around the first bobbin 14.

These two terminal lead lines 10*a* and 10*b* are pulled out in the axial direction via two pillar-shaped holding members 39 formed with the first bobbin 14 unitarily by resin.

The first bobbin 14 that supports both sides of the first coil 10 has a pair of flange plates 14*a*. The pillar-shaped holding members 39 extend to the anti-coil side in an axial direction from one of the flange plates 14*a* that adjoins the iron core plate 12*a*. In addition, hook-like stopping parts 39*a* are provided on tip parts of the pillar-shaped holding members 39.

The lead line passages (for example, a through hole that penetrates an inside of the pillar-shaped holding members 39 in the longitudinal direction, or a slot-shaped opening formed along a longitudinal direction of the pillar-shaped holding members 39, etc.) for letting the terminal lead lines 10*a* and 10*b* of the first coil 10 pass through are formed in the pillar-shaped holding members 39.

The hook-like stopping parts 39*a* provided in the pillar-shaped holding members 39 have stopping surfaces that project towards the approximately right-angled direction to the longitudinal direction of the pillar-shaped holding members 39.

A length in an axial direction from a surface of one of the flange plate 14*a* in which the pillar-shaped holding members 39 are formed to the stopping surfaces is set approximately the same as a thickness of the iron core plate 12*a* plus a length in an axial direction of the auxiliary yoke 29.

The one terminal lead line 10*a* of the first coil 10 is taken out from a tip of the stopping part 39*a* formed in the one pillar-shaped holding member 39, and is connected to a first terminal 40 (refer to FIG. 1).

The other terminal lead line 10*b* is taken out from a tip of the stopping parts 39*a* formed in the other pillar-shaped holding member 39, and is grounded by welding etc. to the surface of the anti-coil side of the plate-like magnetic path member 30 (right-hand side of FIG. 1).

The second coil 11 has, like the first coil 10 two terminal lead lines (not shown) that are a start winding side and an end winding side wound around the second bobbin 24.

The one terminal lead line is connected to a second terminal 41 (refer to FIG. 1), and the other terminal lead line is grounded by welded etc. to the surface of the anti-coil side of the plate-like magnetic path member 30.

The first terminal 40 and the second terminal 41 are fixed to the resin member 31 having the plate-like magnetic path member 30 formed by insertion.

The terminals 40 and 41 are attached to the resin member 31 with their tip parts projected in the axial direction from the bottom portion 26*a* of the resin cover 26 in the state where the resin cover 26 is attached to the whole case 13, (refer to FIG. 1).

As shown in FIG. 2A, an extracting portions 12*c* (for example, an opening, a cut-out groove, a penetration hole, etc.) for extracting the pillar-shaped holding members 39 to the second coil 11 side is formed in the perimeter part of the iron core plate 12*a*.

Extracting portions 30*a* (referring to FIG. 2A) for extracting the stopping parts 39*a* of the pillar-shaped holding members 39 and lead slots (not shown) for pulling out the terminal lead line of the second coil 11 to the anti-coil side of the plate-like magnetic path member 30 are formed in the perimeter part of the plate-like magnetic path member 30.

However, the terminal lead line of the second coil 11 may be pulled out to the anti-coil side of the plate-like magnetic path member 30 using the extracting portions 30*a* formed in the plate-like magnetic path member 30, and the lead slots are unnecessary in this case.

Next, the operation at the time of starting the engine with the starter of the present embodiment is explained.

The idle stop ECU 7 inputs, for example, an engine rotation signal, a position signal of a gear shift lever, ON/OFF signal of a brake switch, etc. through an engine ECU (not shown) that controls engine operational status, and if a condition precedent for stopping the engine is satisfied is judged based on these information, an engine stop signal is transmitted to the engine ECU.

The idle stop ECU 7 transmits a signal of a re-starting demand to the engine ECU and outputs an ON signal to the electromagnetic switching device 1 judging that the re-starting demand is raised when operations in which a driver is going to start the vehicle (for example, a release operation of the brake, shift operation to a drive range, etc.) are performed, after the idle stop operation is performed.

Hereafter, an operation when the re-starting demand occurs in the engine stopping process (during a slowing down period until the engine stops completely) is explained as an example when an idle stop operation is performed.

The idle stop ECU 7 outputs an ON signal to the pinion solenoid 3 first when the re-starting demand occurs in the engine stopping process.

This energizes the first coil 10 connected to the first terminal 40 from the battery 4 via the starter relay 42 (refer to FIG. 5).

Consequently, the plunger 16 is attracted by the magnetized core part 12*b* and moves.

With the movement of the plunger 16, the pinion 2 is pushed out in the anti-motor direction via the gearshift 19, and an end surface of the pinion 2 contacts an end surface of the ring gear 21.

Since rotation of engine is not stopped completely at this moment, that is, the ring gear 21 is rotating while slowing down, the pinion 2 engages to the ring gear 21 by the elasticity stored in the drive spring 22 at the time when the ring gear 21 comes to the position where the pinion 2 can be engaged.

The ON signal is outputted from the idle stop ECU 7 to the motor solenoid 6 delayed by a predetermined time (for example, 30 ms-40 ms) from the output timing of the ON signal to the pinion solenoid 3.

Thereby, the second coil 11 connected to the second terminal 41 is energized from the battery 4 via a relay (not shown), and the movable iron core 25 is attracted by the magnetized core part 12*b* and moves.

The movable contact 28 is pressed by the contact-pressure spring 38 with the movement of the movable iron core 25, and the movable contact 28*a* contacts with a pair of the fixed contacts 27 so that the main switch closes.

Consequently, torque occurs in a rotor 5*a* (refer to FIG. 5) by the energization to the motor 5 from the battery 4, and the torque is transmitted to the output shaft 8, and is further transmitted to the pinion 2 via the clutch 9 from the output shaft 8.

Since the pinion 2 is already engaged to the ring gear 21, the torque of the motor 5 is transmitted to the ring gear 21 from the pinion 2, and starts the engine promptly.

Next, an assembling procedure of the electromagnetic switching device 1 is explained, referring to FIGS. 2A-C and 3A-C.

First, the first coil 10 shown in FIG. 2A, the fixed iron core 12, the auxiliary yoke 29, and the second coil 11 are arranged in the axial direction (vertical direction in the figures), and the fixed iron core 12, the auxiliary yoke 29, and the second coil 11 are attached to the first coil 10 in order.

The first coil 10 before assembling is wound around the first bobbin 14, and two terminal lead lines 10*a* and 10*b* are pulled out in the axial direction (above in the figures) through the line passages formed in two pillar-shaped holding members 39, respectively.

The sleeve 17 that guides the movement of the plunger 16 is equipped in the inner circumference of the first bobbin 14.

The fixed iron core 12 inserts the core part 12*b* in the inner circumference of the iron core plate 12*a*, and both are fixed unitarily.

The fixed iron core 12 is attached to the first coil 10 placing the perimeter part of the iron core plate 12*a* that projects on the outside in the radial direction of the outer diameter of the one adsorption side of the core part 12*b* on an upper surface, in the figure, of the one flange plate 14*a* of the first bobbin 14.

When attaching the fixed iron core 12, the pillar-shaped holding members 39 provided unitarily in the one flange plate 14*a* are taken out above the iron core plate 12*a* in the figure through the extracting portions 12*c* formed in the perimeter part of the iron core plate 12*a*.

The auxiliary yoke 29 is arranged placing one end surface in the axial direction onto the perimeter part surface in the anti-coil side of the iron core plate 12*a* after attaching the fixed iron core 12 to the first coil 10.

In addition, the hook-like stopping parts 39*a* provided in the tip parts of the pillar-shaped holding members 39 fix the auxiliary yoke 29.

That is, the movement of the iron core plate 12*a* and the auxiliary yoke 29 in the axial direction is suppressed relative to the first coil 10 since the stopping surfaces formed in stopping parts 39*a* engage with the other end surfaces in the axial direction of the auxiliary yoke 29.

Figure 2B:
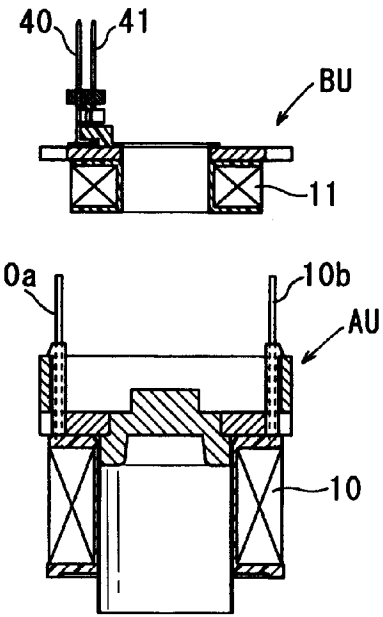

These three parts (the first coil 10, the fixed iron core 12, and auxiliary yoke 29) being combined unitarily are called a first coil unit AU (refer to FIG. 2B).

Next, the second coil 11 wound around the second bobbin 24 is inserted in the inner circumference of the auxiliary yoke 29, and attached in the state where the perimeter part of the plate-like magnetic path member 30 contacts the end surface in the axial direction of the auxiliary yoke 29.

Then, the one terminal lead line 10*a* of the first coil 10 is connected to the first terminal 40, and the other terminal lead line 10*b* is connected (by welding, for example) to the surface of the plate-like magnetic path member 30.

As for the second coil 11, the one terminal lead line is connected to the second terminal 41 beforehand, and the other terminal lead line is connected to the surface of the plate-like magnetic path member 30.

Since the plate-like magnetic path member 30 is formed by insertion with the resin member 31 provided unitarily in the second bobbin 24, the second coil 11, the plate-like magnetic path member 30, and two terminals 40 and 41 are constituted unitarily, This is called a second coil unit BU (refer to FIG. 2B).

Figure 2C:
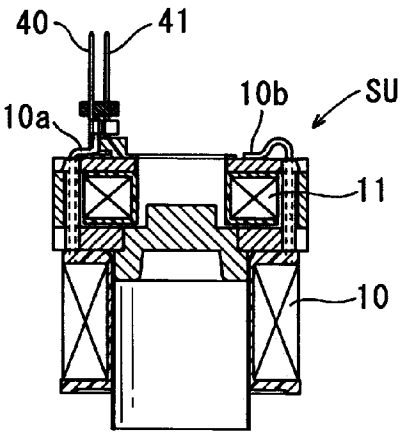

According to the procedures so far, the first coil unit AU and the second coil unit BU are in the state of being united, as shown in FIG. 2C. These united two coil units AU and BU are hereafter called a solenoid unit SU.

Next, as shown in FIG. 3A, after arranging the whole case 13 so that an entrance side (the other end) faces up in the vertical direction and arranging the elastic bodies 15 on the bottom 13*a* of the whole case 13, the solenoid unit SU is accommodated inside the whole case 13.

At this procedure (procedure of accommodating the solenoid unit SU inside the whole case 13), the solenoid unit SU can be accommodated inside the whole case 13 maintaining the state where the first coil unit AU is hung in a lower part in the figure to the second coil unit BU by supporting the perimeter side in the radial direction of the auxiliary yoke 29 by a jig 43, etc.

FIG. 3B shows the state where the solenoid unit SU is accommodated inside the whole case 13.

Then, as shown in FIG. 3C, each part used for the motor solenoid 6 (the return spring 32, the movable iron core 25 plus the rod 37, the movable contact 28, the contact-pressure spring 38, and the resin cover 26) are attached, and the opening end of the whole case 13 is fixed by crimping to the level difference part of the resin cover 26.

When attaching the resin cover 26, the two terminals 40 and 41 are taken out to the outside of the resin cover 26 through the penetration hole formed in the bottom portion 26*a* of the resin cover 26

Effect of the Embodiment

Since the first coil unit AU and the second coil unit BU are accommodated in one whole case 13 in the state where being arranged axially in line in the axial direction, the electromagnetic switching device 1 of the present embodiment has the whole case 13 being long in the axial direction.

On the other hand, in the present embodiment, since the first coil unit AU and the second coil unit BU are not accommodated separately but the solenoid unit SU that is the coil units AU and BU being united is accommodated inside the whole case 13, two coil units AU and BU can be easily accommodated inside the whole case 13 in one operation.

According to this method, it is not necessary to accommodate while supporting the first coil unit AU independently into the whole case 13 deeply, but the first coil unit AU can be accommodated inside the whole case 13 maintaining the state where the first coil unit AU is hung in the lower part to the second coil unit BU by supporting the perimeter side of the auxiliary yoke 29 arranged at the entrance side of the whole case 13.

Consequently, the assembling nature can be improved, as well as the cost cut by shortening the assembling time can be realized.

Further, the first coil unit AU is assembled by engaging the hook-like stopping parts 39*a* provided in the tip part of the pillar-shaped holding members 39 to the end surface in the axial direction of the auxiliary yoke 29 after combining the first coil 10 wound around the first bobbin 14, the fixed iron core 12 and the auxiliary yoke 29.

The terminal lead lines 10*a* and 10*b* of the first coil 10 are pulled out in the axial direction through the inside of two pillar-shaped holding members 39 (lead line passage) used in order to assemble the first coil unit AU.

According to this composition, since it is not necessary to provide the lead means for pulling out the terminal lead lines 10*a* and 10*b* of the first coil 10 in the axial direction independently from the pillar-shaped holding members 39, the cost needed to provide the lead means becomes unnecessary.

In addition, since it is not necessary to secure the space for providing the lead means for exclusive use, reduction in cost and miniaturization of the electromagnetic switching device 1 become possible.

Further, since the pillar-shaped holding members 39 can be formed unitarily with the resin-made first bobbin 14, the number and cost of parts do not increase.

When assembling the first coil unit AU, that is, when the stopping parts 39*a* provided in the tip part of the pillar-shaped holding members 39 pass through the inner circumference of the auxiliary yoke 29 in the axial direction, the tip of the stopping surface (tip in the direction that intersects perpendicularly to the longitudinal of direction the pillar-shaped holding members 39) contacts the inner circumference of the auxiliary yoke 29.

Therefore, predetermined load is given to the inner circumference of the auxiliary yoke 29, and bending arises in the pillar-shaped holding members 39 according to the elasticity.

Here, since the length of the pillar-shaped holding members 39 in the axial direction has a size equivalent to the length of the auxiliary yoke 29 in the axial direction plus the thickness of the iron core plate 12*a*, the length in the axial direction to a section coefficient of a cross section can be lengthened.

Moreover, since the stopping parts 39*a* are provided in the tip part of the pillar-shaped holding members 39, the pillar-shaped holding members 39 can be easily bent by a small load.

As a result, since the load that bends the pillar-shaped holding members 39 can be made small when the stopping parts 39*a* pass through the inner circumference of the auxiliary yoke 29 in the axial direction, the assembling becomes easy.

Modification

In the above-mentioned embodiment, two pillar-shaped holding members 39 are used in order to assemble the first coil unit AU, but it is not limited to two, and three or more pillar-shaped holding members 39 can also be formed.

Although the example shows that the pillar-shaped holding members 39 are formed with the first bobbin 14 unitarily by resin, the pillar-shaped holding members 39 maybe provided separately from the first bobbin 14, and the pillar-shaped holding members 39 can be fixed by inserting the end part of the pillar-shaped holding members 39 in a hole opened in the one flange plate 14*a* of the first bobbin 14, for example.

Further, the pillar-shaped holding members 39 may be formed in the second bobbin 24 sides.

What is claimed is:

1. An electromagnetic switching device comprising:

a solenoid for pinion extrusion that extrudes a starter's pinion in a axial direction by using an attraction force of an electromagnet generated by an energization to a first coil that is wound around a first bobbin; and a solenoid for motor energization that closes a main switch that intermits a current flowing to a starter motor from a battery by using an attraction force of an electromagnet generated by an energization to a second coil that is wound around a second bobbin; wherein, the solenoid for pinion extrusion and the solenoid for motor energization are arranged axially in line in an axial direction to constitute the electromagnetic switching device for starters unitarily, the electromagnetic switching device further comprising:

a case having a cylindrical shape with a bottom that has a ring-shaped bottom at one end side in an axial direction and an opening at other end side, wherein, the first coil and the second coil are accommodated in a bottom side within the case and in an top side within the case, respectively, an iron core plate that forms a part of magnetic circuit for the first coil and the second coil is arranged between the both coils, the first bobbin has a pair of flange plates that hold both sides in an axial direction of the first coil, the first bobbin has a plurality of holding members that extend in the axial direction to the second coil side from one of the flange plates in the iron core plate side, and stopping parts provided in the holding members, extracting portions that can extract the holding members to the second coil side is formed in the iron core plate, the holding members are extracted from the extracting portions to the second coil side in the state where the iron core plate is arranged between the first coil and the second coil, and the solenoid for pinion extrusion and the solenoid for motor energization are accommodated in the case in the state where the first coil and the second coil are united by engaging the stopping parts to parts of the solenoid for motor energization.

2. The electromagnetic switching device according to claim 1, wherein, a lead line passage is formed in the holding member, and a terminal lead line of the first coil is pulled out in an axial direction through the lead line passage.

3. The electromagnetic switching device according to claim 2, wherein, the lead line passage is a through hole that penetrates an inside of the holding member in the longitudinal direction, or a slot-shaped opening formed along a longitudinal direction of the holding member.

4. The electromagnetic switching device according to claim 1, wherein, the solenoid for motor energization comprises:

a magnetic path member that intersects perpendicularly with an axial direction of the second coil, and is arranged at an anti-iron core plate side of the second coil to form a part of magnetic circuit, and a cylindrical auxiliary yoke inserted touching an inner circumference of the case, and is arranged between the iron core plates and the magnetic path members through an outside in a radial direction of the second coil to connect the iron core plates and the magnetic path members magnetically, the pillar-shaped holding members are arranged passing through an inner circumference side of the auxiliary yoke in the axial direction, and the stopping parts provided in a tip part of the holding members are engaging with an end surface in an axial direction of the anti-iron core plate of the auxiliary yoke.

5. The electromagnetic switching device according to claim 4, wherein, the stopping parts provided in the tip part of the holding members have stopping surfaces that project towards an approximately right-angled direction to a longitudinal direction of the holding members, and the stopping surfaces engage with the end surface in the axial direction of the anti-iron core plate of the auxiliary yoke.

6. The electromagnetic switching device according to claim 4, wherein, the magnetic path member is formed by insertion to a resin member provided in the second bobbin unitarily, and constituted with the second coil unitarily.

7. The electromagnetic switching device according to claim 6, wherein, a first terminal and a second terminal that are connected to the battery are fixed to the resin member provided in the second bobbin unitarily, in the two terminal lead lines of the first coil pulled out in the axial direction through the lead line passage formed in the holding member, one of the terminal lead lines is connected to the first terminal, while the other one of the terminal lead lines of the first coil is connected to the magnetic path member and grounded, and in the two terminal lead lines of the second coil, one of the terminal lead lines is connected to the second terminal, while the other one of the terminal lead lines of the second coil is connected to the magnetic path member and grounded.

* * * * *